US010462560B2

(12) United States Patent
Timothy et al.

(10) Patent No.: US 10,462,560 B2
(45) Date of Patent: Oct. 29, 2019

(54) DRIVER ASSEMBLIES, HEADPHONES INCLUDING DRIVER ASSEMBLIES, AND RELATED METHODS

(71) Applicant: Skullcandy, Inc., Park City, UT (US)

(72) Inventors: John Timothy, Salt Lake City, UT (US); Branden Sheffield, Saratoga Springs, UT (US); Randall J. Hull, Park City, UT (US); Sam Noertker, Oakley, UT (US); Gregory R. Woolston, Salt Lake City, UT (US); Andrew Pierce, Salt Lake City, UT (US)

(73) Assignee: SkullCandy, Inc., Park City, UT (US)

( * ) Notice: Subject to any disclaimer, the term of this patent is extended or adjusted under 35 U.S.C. 154(b) by 0 days.

(21) Appl. No.: 15/864,307

(22) Filed: Jan. 8, 2018

(65) Prior Publication Data

US 2019/0215603 A1 Jul. 11, 2019

(51) Int. Cl.
*H04R 9/06* (2006.01)
*H04R 1/28* (2006.01)
(Continued)

(52) U.S. Cl.
CPC ..... *H04R 1/2896* (2013.01); *H04R 1/1008* (2013.01); *H04R 1/1075* (2013.01); *H04R 9/025* (2013.01); *H04R 9/06* (2013.01); *H04R 9/066* (2013.01); *H04R 2400/03* (2013.01); *H04R 2400/07* (2013.01)

(58) Field of Classification Search
CPC .... H04R 1/1008; H04R 1/2896; H04R 9/025; H04R 9/06; H04R 11/02; H04R 2400/03; H04R 2400/07; H04R 9/066
USPC ..... 381/370, 396, 398, 151, 353, 354, 403, 381/412; 340/388.1, 407.1
See application file for complete search history.

(56) References Cited

U.S. PATENT DOCUMENTS 5,956,622 A * 9/1999 Lee ..... H04R 1/00 340/407.1
6,208,237 B1 * 3/2001 Saiki ..... H04M 1/03 340/388.1
(Continued)

FOREIGN PATENT DOCUMENTS

EP 1841278 A1 3/2006

OTHER PUBLICATIONS

European Extended Search Report and Opinion for European Application No. 19150496.8, dated Jun. 3, 2019, 8 pages.

*Primary Examiner* — Huyen D Le
(74) *Attorney, Agent, or Firm* — TraskBritt

(57) ABSTRACT

A driver assembly comprises a housing structure, a magnet assembly within the housing structure, and opposing spring structures coupled to the housing structure at different vertical positions than one another. The magnet assembly comprises a permanent magnet, a plate structure underlying the permanent magnet, a voice coil circumscribing the permanent magnet and the plate structure, and a yoke structure at least partially surrounding the permanent magnet, the plate structure, and the voice coil. The opposing spring structures are configured to impede horizontal movement of the permanent magnet, the plate structure, and the yoke structure while permitting vertical movement thereof. A headphone and a method of forming a headphone are also described.

19 Claims, 7 Drawing Sheets

(51) Int. Cl.
*H04R 1/10* (2006.01)
*H04R 9/02* (2006.01)

(56) References Cited

U.S. PATENT DOCUMENTS

| | | | | |
|---|---|---|---|---|
| 6,570,993 | B1 * | 5/2003 | Fukuyama | G10K 9/22 340/388.1 |
| 2007/0182257 | A1 | 8/2007 | Miura et al. | |
| 2012/0170795 | A1 | 7/2012 | Sancisi et al. | |

* cited by examiner

DRIVER ASSEMBLIES, HEADPHONES INCLUDING DRIVER ASSEMBLIES, AND RELATED METHODS

FIELD

The disclosure, in various embodiments, relates generally to driver assemblies, to ear-cup assemblies and headphones including driver assemblies, and to related methods of forming headphones. More specifically, embodiments of the disclosure relate to driver assemblies including a housing structure, a magnet assembly, and opposing spring structures operatively associated with the housing structure and the magnet assemblies, to ear-cup assemblies and headphones including such driver assemblies, and to methods of forming such headphones.

BACKGROUND

Conventional headphones include two ear-cup housings each including one or more driver assemblies that produce audible sound waves and haptic communication. A driver assembly may, for example, include a magnet assembly secured within a driver housing, and a spring diaphragm adjacent the magnet assembly and attached to the driver housing. The positive and negative electrical terminals for the driver are respectively soldered to ends of wires, which extend to an audio jack (e.g., a tip-sleeve (TS) connector, a tip-ring-sleeve (TRS) connector, a tip-ring-ring-sleeve (TRRS) connector, etc.). The audio jack may be coupled to a media player such as a mobile phone, a digital media player, a computer, a television, etc., and the audio signal is transmitted to the driver assembly within the headphone through the wires.

The performance of a headphone is conventionally a function of the driver assembly (or driver assemblies) and the ear-cup housing within which the driver assembly (or driver assemblies) is disposed. The driver assembly (or driver assemblies) and the ear-cup housing of conventional headphones typically define cavities that affect the acoustics and haptic communication of the headphone. Thus, the manufacturer of the headphones may design the ear-cup housing and driver assembly (or driver assemblies) of a headphone so as to provide the headphone with acoustics and haptic communication deemed desirable by the manufacturer.

BRIEF SUMMARY

In accordance with one embodiment described herein, a driver assembly comprises a housing structure, a magnet assembly within the housing structure, and opposing spring structures coupled to the housing structure at different vertical positions than one another. The magnet assembly comprises a permanent magnet, a plate structure underlying the permanent magnet, a voice coil circumscribing the permanent magnet and the plate structure, and a yoke structure at least partially surrounding the permanent magnet, the plate structure, and the voice coil. The opposing spring structures are configured to impede horizontal movement of the permanent magnet, the plate structure, and the yoke structure while permitting vertical movement thereof.

In additional embodiments, a headphone comprises an ear-cup housing and a driver assembly disposed at least partially within the ear-cup housing. The driver assembly comprises a housing structure, a magnet assembly within the housing structure, and opposing spring structures coupled to the housing structure at different vertical positions than one another. The magnet assembly comprises a permanent magnet, a plate structure underlying the permanent magnet, a voice coil circumscribing the permanent magnet and the plate structure, and a yoke structure at least partially surrounding the permanent magnet, the plate structure, and the voice coil. The opposing spring structures are configured to impede horizontal movement of the permanent magnet, the plate structure, and the yoke structure while permitting vertical movement thereof.

In additional embodiments, a method of forming a headphone comprises forming a driver assembly, and securing the driver assembly within an ear-cup housing. The driver assembly comprises a housing structure, a magnet assembly within the housing structure, and opposing spring structures coupled to the housing structure at different vertical positions than one another. The magnet assembly comprises a permanent magnet, a plate structure underlying the permanent magnet, a voice coil circumscribing the permanent magnet and the plate structure, and a yoke structure at least partially surrounding the permanent magnet, the plate structure, and the voice coil. The opposing spring structures are configured to impede horizontal movement of the permanent magnet, the plate structure, and the yoke structure while permitting vertical movement thereof.

DETAILED DESCRIPTION

Figure 1A:
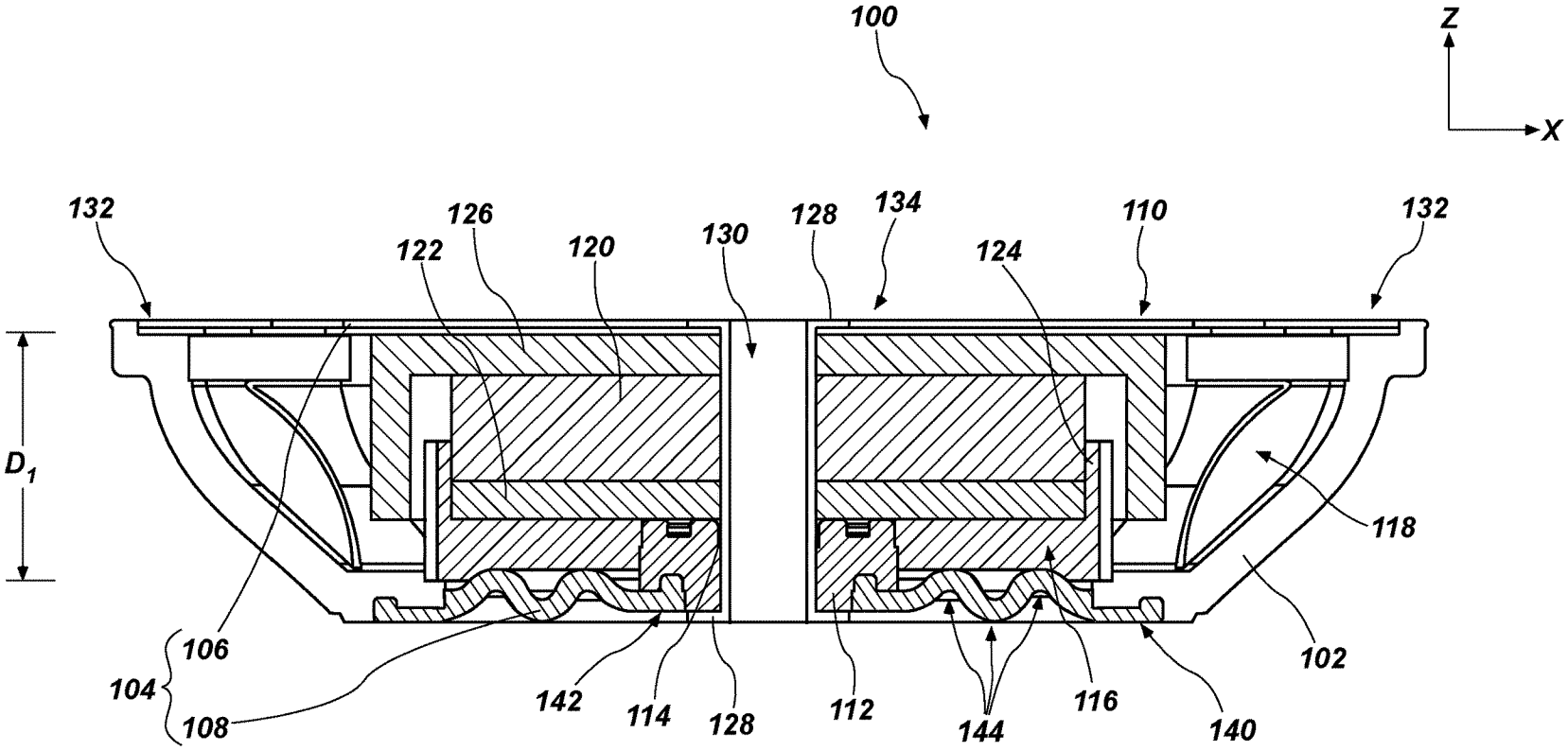
FIGS. 1A through 1C are simplified cross-sectional (FIG. 1A), top-down (FIG. 1B), and bottom-up (FIG. 1C) views of a driver assembly, in accordance with an embodiment of the disclosure.

Driver assemblies (e.g., acoustic driver assemblies, haptic driver assemblies, hybrid driver assemblies) are disclosed, as are ear-cup assemblies and headphones including the driver assemblies, and methods of forming the headphones. In some embodiments, a driver assembly includes a housing structure, a magnet assembly within the housing structure, and opposing spring structures operatively associated with the housing structure and the magnet assembly. The opposing spring structures are configured and positioned to limit (e.g., impede, obstruct, hinder) horizontal movement of one or more components (e.g., a permanent magnet, a plate structure, a yoke structure, etc.), while permitting vertical movement (e.g., upward movement and downward movement, pistonic movement) of the one or more components of the magnet assembly. Limiting horizontal movement of the one or more components may reduce the risk of damage to the driver assembly that may otherwise result from such horizontal movement. The opposing spring structures may also be configured and positioned to reduce vibration amplitude at resonance of components of the driver assembly as compared to conventional driver assemblies.

The following description provides specific details, such as material compositions and processing conditions, in order to provide a thorough description of embodiments of the present disclosure. However, a person of ordinary skill in the art would understand that the embodiments of the disclosure may be practiced without employing these specific details. Indeed, the embodiments of the disclosure may be practiced in conjunction with conventional driver assembly fabrication techniques employed in the industry. In addition, the description provided below does not form a complete process flow for manufacturing a driver assembly or audio device (e.g., headphone). Only those process acts and structures necessary to understand the embodiments of the disclosure are described in detail below. Additional acts to form a complete audio device from the structures and assemblies described herein may be performed by conventional fabrication processes.

Drawings presented herein are for illustrative purposes only, and are not meant to be actual views of any particular material, component, structure, device, or assembly. Variations from the shapes depicted in the drawings as a result, for example, of manufacturing techniques and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or described as round may include some rough and/or linear features. Moreover, sharp angles that are illustrated may be rounded, and vice versa. Thus, the regions illustrated in the figures are schematic in nature, and their shapes are not intended to illustrate the precise shape of a region and do not limit the scope of the present claims. The drawings are not necessarily to scale. Additionally, elements common between figures may retain the same numerical designation.

As used herein, the term "configured" refers to a size, shape, material composition, material distribution, orientation, and arrangement of one or more of at least one structure and at least one apparatus facilitating operation of one or more of the structure and the apparatus in a predetermined way.

As used herein, the terms "longitudinal," "vertical," "lateral," and "horizontal" are in reference to a major plane of a substrate (e.g., base material, base structure, base construction, etc.) in or on which one or more structures and/or features are formed and are not necessarily defined by earth's gravitational field. A "lateral" or "horizontal" direction is a direction that is substantially parallel to the major plane of the substrate, while a "longitudinal" or "vertical" direction is a direction that is substantially perpendicular to the major plane of the substrate. The major plane of the substrate is defined by a surface of the substrate having a relatively large area compared to other surfaces of the substrate.

As used herein, the terms "comprising," "including," "containing," "characterized by," and grammatical equivalents thereof are inclusive or open-ended terms that do not exclude additional, unrecited elements or method steps, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

As used herein, the singular forms "a," "an," and "the" are intended to include the plural forms as well, unless the context clearly indicates otherwise.

As used herein, "and/or" includes any and all combinations of one or more of the associated listed items.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "below" or "beneath" or "under" or "on bottom of" other elements or features would then be oriented "above" or "on top of" the other elements or features. Thus, the term "below" can encompass both an orientation of above and below, depending on the context in which the term is used, which will be evident to one of ordinary skill in the art. The materials may be otherwise oriented (e.g., rotated 90 degrees, inverted, flipped) and the spatially relative descriptors used herein interpreted accordingly.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, at least 99.9% met, or even 100.0% met.

As used herein, the term "about" in reference to a given parameter is inclusive of the stated value and has the meaning dictated by the context (e.g., it includes the degree of error associated with measurement of the given parameter).

Figure 1B:
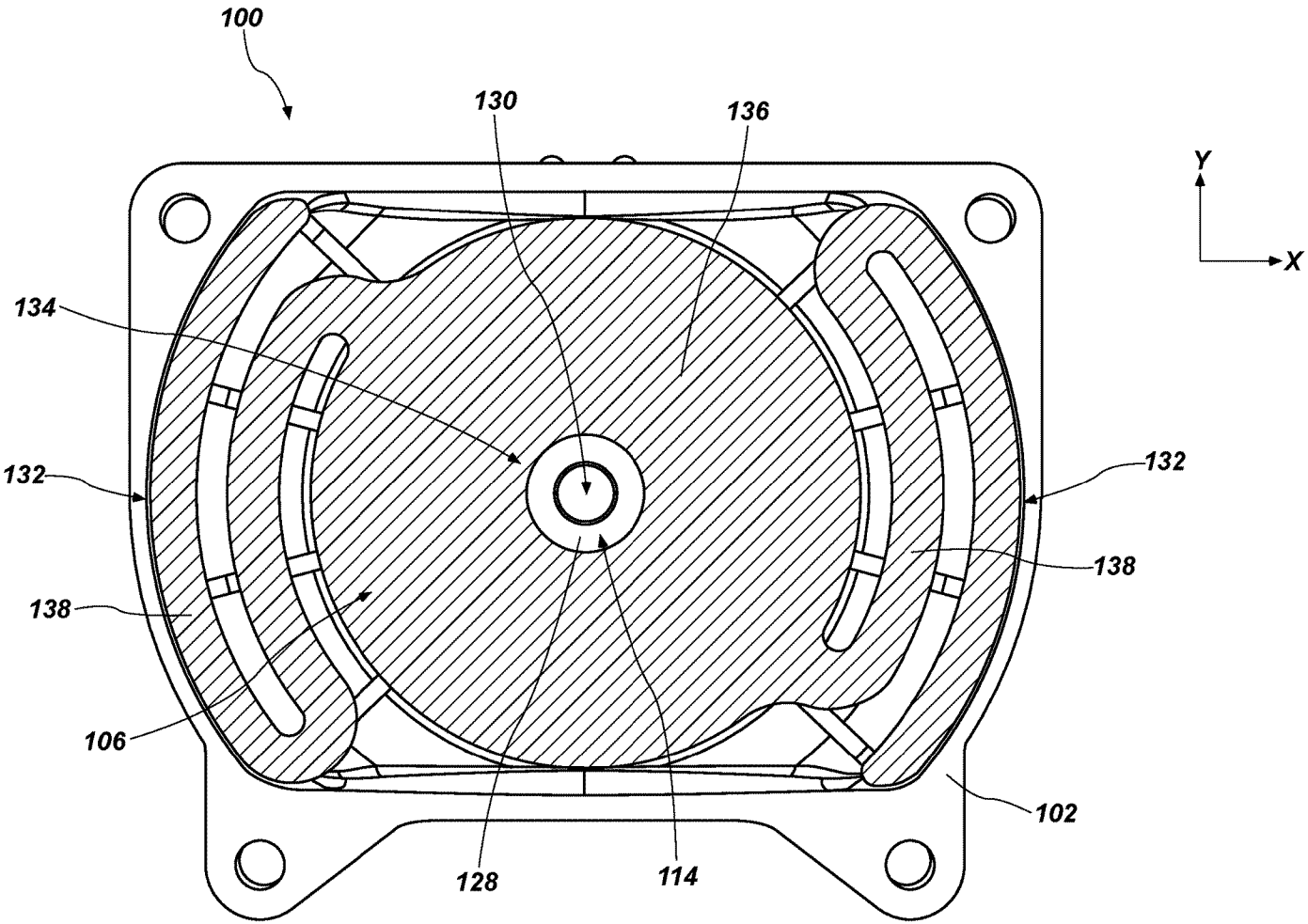
Figure 1C:
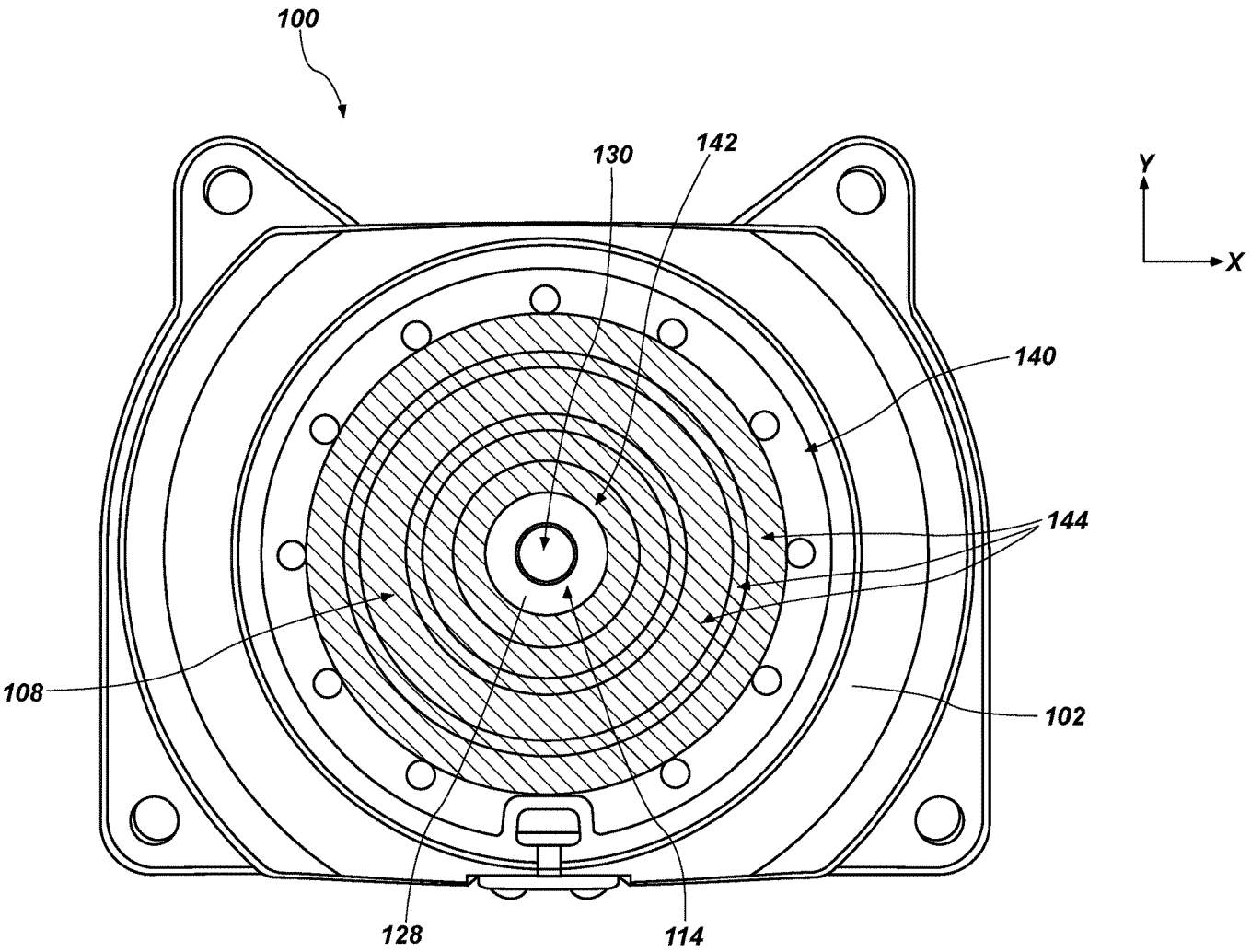

FIG. 1A is a simplified cross-sectional view illustrating a driver assembly 100, in accordance with an embodiment of the disclosure. The driver assembly 100 may comprise an audio driver assembly configured to produce audible sound waves, a haptic driver assembly configured to produce haptic communication, or a hybrid driver assembly configured to produce audible sound waves and haptic communication. The driver assembly 100 includes a housing structure 102, opposing spring structures 104 (e.g., opposing spring structures) secured to opposing ends of the housing structure 102, and a magnet assembly 110 disposed within the housing structure 102 and vertically between the opposing spring structures 104. The opposing spring structures 104 may include an upper spring structure 106, and a lower spring structure 108 underlying the upper spring structure 106. Optionally, the driver assembly 100 may also include a spacer structure 112 disposed vertically between the magnet assembly 110 and the lower spring structure 108, and a tubular structure 114 coupled to the opposing spring structures 104 and vertically extending through the magnet assembly 110 and the spacer structure 112 (if any). While FIG. 1A depicts a particular configuration of the driver assembly 100, one of ordinary skill in the art will appreciate that different driver assembly configurations are known in the art that may be adapted to be employed in embodiments of the disclosure. FIG. 1A illustrates just one non-limiting example of the driver assembly 100. FIG. 1B is a simplified top-down view of the driver assembly 100, and FIG. 1C is a simplified bottom-up view of the driver assembly 100.

The housing structure 102 may be configured to be secured within an outer ear-cup housing of an ear-cup assembly, and includes at least one structure configured to at least partially enclose the magnet assembly 110. The housing structure 102 may be positioned over one or more sides (e.g., at least a back side) of the magnet assembly 110. An acoustical cavity 116 may be disposed between the housing structure 102 and the one or more sides of the magnet assembly 110. The housing structure 102 may also exhibit one or more apertures 118 (e.g., ports, holes, etc.) extending therethrough. The location and configuration (e.g., size, shape, etc.) of the apertures 118 may be selected to provide a desired emitted sound pressure level (SPL) profile, and/or a desired detectable SPL profile, for the driver assembly 100 and a headphone including the driver assembly 100. The apertures 118 may, for example, extend through one or more side portions of the housing structure 102. The housing structure 102 may be formed of and include at least one rigid material, such as one or more of a metal material (e.g., a metal, an alloy, etc.) and a polymer material (e.g., a plastic).

The magnet assembly 110 may include a permanent magnet 120, a plate structure 122 (e.g., top plate) underlying the permanent magnet 120, a voice coil 124 circumscribing the permanent magnet 120 and the plate structure 122, and a yoke structure 126 at least partially surrounding the permanent magnet 120, the plate structure 122, and the voice coil 124. As shown in FIG. 1A, the permanent magnet 120 may be located on (e.g., directly physically contact, abut, etc.) the plate structure 122, and the yoke structure 126 may be located on an upper surface of the permanent magnet 120. The yoke structure 126 may at least partially extend over and surround (e.g., cover, envelop, etc.) peripheral sidewalls (e.g., outer sidewalls) of each of the permanent magnet 120 and the plate structure 122. At least a portion of the voice coil 124 may be located within a cavity at least partially defined by inner sidewalls of the yoke structure 126 and the peripheral sidewalls of each of the permanent magnet 120 and the plate structure 122. The voice coil 124 may be offset (e.g., spaced apart, separated, etc.) and electrically isolated from each of the permanent magnet 120, the plate structure 122, and the yoke structure 126. The plate structure 122 and the yoke structure 126 may each individually be formed of and include one or more of an electrically conductive material (e.g., a metal material, such a metal, a metal alloy, etc.) and electrically non-conductive material (e.g., a non-conductive polymer material, such as a non-conductive plastic). The permanent magnet 120 and the voice coil 124 may each individually be formed of and include an electrically conductive material (e.g., a metal material, such a metal, a metal alloy, etc.).

The spacer structure 112, if present, may be positioned vertically adjacent at least one surface (e.g., a lower surface of the plate structure 122) of the magnet assembly 110 so as to partially intervene between the magnet assembly 110 and the lower spring structure 108. The spacer structure 112 may be centrally horizontally positioned relative to horizontal dimensions of each of the magnet assembly 110 and the opposing spring structures 104. The spacer structure 112 may be configured to permit movement of one or more components (e.g., the permanent magnet 120, the plate structure 122, and the yoke structure 126) of the magnet assembly 110 and the spacer structure 112 responsive to a magnetic field produced by the voice coil 124 of the magnet assembly 110 upon receiving a signal from a media player. As shown in FIG. 1A, in some embodiments, the spacer structure 112 includes one or more vertical projections and one or more horizontal projections. The magnet assembly 110 and/or the lower spring structure 108 may be attached (e.g., adhered, bonded, coupled, etc.) to one or more portions of the vertical projections and/or the horizontal projections of the spacer structure 112. The spacer structure 112 may be formed of and include at least one of a polymer material (e.g., a plastic) and metal material (e.g., a metal, an alloy, etc.). In additional embodiments, the spacer structure 112 is absent (e.g., omitted) from the driver assembly 100.

The tubular structure 114, if present, may be at least partially provided within and may vertically extend through aligned, centrally horizontally positioned apertures in the opposing spring structures 104, the magnet assembly 110, and the spacer structure 112 (if any). The tubular structure 114 may at least partially (e.g., substantially) define a central vertical aperture 130 of the driver assembly 100. The tubular structure 114 may be attached (e.g., adhered, bonded, coupled, etc.) to one or more surfaces one or more (e.g., each) of the opposing spring structures 104, the magnet assembly 110, and the spacer structure 112 (if any). As shown in FIG. 1A, the tubular structure 114 may exhibit horizontal projections 128 at opposing vertical ends (e.g., a lower vertical end, and an upper vertical end opposing the lower vertical end) thereof. In some embodiments, the horizontal projections 128 of the tubular structure 114 are attached to the opposing spring structures 104 (e.g., the upper spring structure 106 and the lower spring structure 108) of the driver assembly 100. In additional embodiments, a portion of the horizontal projections 128 (e.g., the horizontal projection(s) 128 most proximate the lower spring structure 108) are attached to the spacer structure 112 (if any) (e.g., a lower surface of the spacer structure 112), and/or a portion of the horizontal projections 128 (e.g., the horizontal projection(s) 128 most proximate the upper spring structure 106) are attached to the yoke structure 126 (e.g., an upper surface of the yoke structure 126) of the magnet assembly 110. The tubular structure 114 may be formed of and include at least one of a polymer material (e.g., a plastic) and metal material (e.g., a metal, a metal alloy, etc.). In additional embodiments, the tubular structure 114 is absent (e.g., omitted) from the driver assembly 100. For example, the opposing spring structures 104, the magnet assembly 110, and the spacer structure 112 (if any) may exhibit aligned, centrally horizontally positioned apertures without the tubular structure 114 vertically extending therethrough.

With continued reference to FIG. 1A, the opposing spring structures 104 (e.g., the upper spring structure 106, and the lower spring structure 108) of the driver assembly 100 are configured and positioned to limit horizontal movement (e.g., side-to-side movement, rocking movement, etc.) of one or more components of the magnet assembly 110, while also permitting vertical movement (e.g., upward movement and downward movement, pistonic movement) of the one or more components of the magnet assembly 110. The opposing spring structures 104 may mitigate (or even prevent) undesirable movement (e.g., undesirable vibration modes) of the magnet assembly 110. For example, the opposing spring structures 104 may be configured and positioned to substantially limit horizontal movement of the permanent magnet 120, the plate structure 122, and the yoke structure 126 of the magnet assembly 110, while permitting vertical movement of the permanent magnet 120, the plate structure 122, and the yoke structure 126 of the magnet assembly 110. Limiting the horizontal movement of the one or more components of the magnet assembly 110 using the opposing spring structures 104 may prevent damage to the magnet assembly 110 that may otherwise occur if the opposing spring structures 104 were not present in the driver assembly 100. By way of non-limiting example, the opposing spring structures 104 may prevent damage to (e.g., breakage of) the voice coil 124 (e.g., which may remain stationary during movement of the permanent magnet 120, the plate structure 122, and the yoke structure 126) that may otherwise occur if horizontal movement of the permanent magnet 120, the plate structure 122, and the yoke structure 126 were unimpeded. Such unimpeded horizontal movement may, for example, occur if a headphone including a conventional driver assembly were dropped and/or suddenly moved (e.g., jerked). In addition, the opposing spring structures 104 may provide the driver assembly 100 with desired vibrational properties. For example, the opposing spring structures 104 may be configured and positioned to reduce the vibration amplitude at resonance of one or more components of driver assembly 100 (e.g., components of the magnet assembly 110, such as the permanent magnet 120, the plate structure 122, and the yoke structure 126; the spacer structure 112 (if any); the tubular structure 114 (if any); the opposing spring structures 104; etc.). The opposing spring structures 104 may facilitate a relatively more even (e.g., uniform) vibration response for the driver assembly 100 across a relatively wider range of frequencies.

As shown in FIG. 1A, the upper spring structure 106 of the opposing spring structures 104 may be positioned on or over the yoke structure 126 of the magnet assembly 110. In some embodiments, such as embodiments wherein the driver assembly 100 comprises an audio driver assembly, the upper spring structure 106 is an audio producing component of the driver assembly 100. In additional embodiments, such as embodiments wherein the driver assembly 100 comprises a haptic driver assembly, the upper spring structure 106 is not an audio producing component of the driver assembly 100. Horizontally peripheral portions 132 (e.g., horizontally outermost portions) of the upper spring structure 106 may be attached (e.g., coupled, bonded, adhered, connected, etc.) to the housing structure 102, and a horizontally central portion 134 of the upper spring structure 106 may be attached to one or more (e.g., each) of the yoke structure 126 and the tubular structure 114 (if any). The upper spring structure 106 may be configured to vibrate in accordance with the vertical movement of one or more components (e.g., the permanent magnet 120 and the yoke structure 126) of the magnet assembly 110 responsive to a magnetic field produced by the voice coil 124 of the magnet assembly 110 upon receiving an audio signal.

Referring to FIG. 1B, the upper spring structure 106 includes a central structure 136 at least partially (e.g., substantially) overlying the magnet assembly 110 (FIG. 1A), and one or more (e.g., a plurality of) leg structures 138 horizontally extending from the central structure 136. The central structure 136 may include the horizontally central portion 134 attached to one or more of the magnet assembly 110 (FIG. 1A) and the tubular structure 114, and the leg structures 138 may include the horizontally peripheral portions 132 attached to the housing structure 102. The central structure 136 and the leg structures 138 may be integral and continuous with one another, such that the upper spring structure 106 comprises a substantially monolithic structure. As used herein, the term "monolithic structure" means and includes a structure formed as, and comprising a single (e.g., only one), unitary structure of a material. The upper spring structure 106 may not, for example, exhibit joint structures (e.g., weld joints, braze joints, solder joints, adhesive joints, etc.) and/or materials intervening between and coupling the central structure 136 and the leg structures 138. In additional embodiments, the central structure 136 is connected (e.g., coupled, bonded, adhered, attached, etc.) to the leg structures 138 through one or more joint structures (e.g., weld joints, braze joints, solder joints, adhesive joints, etc.) and/or materials.

The central structure 136 may exhibit any desired geometric configuration (e.g., shape and size). The central structure 136 may, for example, exhibit a horizontal geometric configuration (e.g., a horizontal shape and horizontal sizes) at least partially complementary to (e.g., substantially similar to) a horizontal geometric configuration of at least a portion of the magnet assembly 110 (FIG. 1A) thereunder. By way of non-limiting example, the central structure 136 may exhibit a curved shape (e.g., an annular shape, a circular shape, an ovular shape, an elliptical shape, etc.) exhibiting a radius of curvature substantially similar to that of the yoke structure 126 (FIG. 1A) of the magnet assembly 110 (FIG. 1A). Outermost horizontal boundaries of the central structure 136 may be substantially coplanar with outermost horizontal boundaries of the yoke structure 126. In additional embodiments, the central structure 136 may exhibit a different geometric configuration (e.g., a different shape and/or a different size). For example, the central structure 136 may exhibit a shape (e.g., a curved shape, a non-curved shape) exhibiting a different radius of curvature than that of the yoke structure 126 (FIG. 1A) of the magnet assembly 110 (FIG. 1A), and/or at least a portion of the outermost horizontal boundaries of the central structure 136 may be non-coplanar with the outermost horizontal boundaries of the yoke structure 126.

With continued reference to FIG. 1B, the leg structures 138 may extend in substantially non-linear paths between the central structure 136 and the housing structure 102. For example, the leg structures 138 may outwardly horizontally extend from the central structure 136 to the housing structure 102 in curved paths (e.g., oscillating paths, winding paths). In additional embodiments, one or more of the leg structures 138 may extend in different paths (e.g., substantially linear paths; different substantially non-linear paths, such as different arcuate paths, angled paths, jagged paths, sinusoidal paths, V-shaped paths, U-shaped paths, irregularly shaped paths, combinations thereof, etc.) than those shown in FIG. 1B. The leg structures 138 may each exhibit substantially the same shape (e.g., substantially the same non-linear shape, such as substantially the same curved horizontal shape; substantially the same non-curved horizontal shape) and substantially the same size (e.g., substantially the same horizontal dimensions), or at least one of the leg structures 138 may exhibit a different shape (e.g., a different curved horizontal shape, a curved horizontal shape versus a non-curved horizontal shape, etc.) and/or a different size (e.g., one or more different horizontal dimensions) than at least one other of the leg structures 138.

The leg structures 138 may be separated (e.g., circumferentially separated) from one another by any desired distance(s). For example, each of the leg structures 138 may be circumferentially separated from each other of the leg structures 138 adjacent thereto by substantially the same distance (e.g., such that the leg structures 138 are substantially uniformly circumferentially spaced apart), or at least one of the leg structures 138 may be circumferentially separated from one of the leg structures 138 adjacent thereto by a different distance than that between of the at least one of the leg structures 138 and another of the leg structures 138 circumferentially adjacent thereto (e.g., such that the leg structures 138 are non-uniformly circumferentially spaced). The distance between circumferentially adjacent leg structures 138 at least partially depends on the configurations of the leg structures 138, and on the desired suspension and vibrational characteristics (e.g., resonance frequency characteristics) of the upper spring structure 106. In some embodiments, the leg structures 138 are substantially uniformly circumferentially spaced apart from one another. In additional embodiments, the leg structures 138 are non-uniformly circumferentially spaced apart from one another.

The upper spring structure 106 may include any quantity and any distribution of the leg structures 138 that permits the upper spring structure 106, in combination with the lower spring structure 108, to limit horizontal movement of one or more components of the magnet assembly 110; and that permits the upper spring structure 106, in combination with the lower spring structure 108, to provide the driver assembly 100 with desired acoustic properties. The quantity and the distribution of the leg structures 138 may at least partially depend on the configurations (e.g., material compositions, material distributions, shapes, sizes, orientations, arrangements, etc.) of the upper spring structure 106, the lower spring structure 108, and the other components (e.g., the magnet assembly 110, the spacer structure 112 (if any), the tubular structure 114 (if any)) of the driver assembly 100. As shown in FIG. 1B, in some embodiments, the upper spring structure 106 includes two (2) of the leg structures 138. In additional embodiments, the upper spring structure 106 includes a different number of the leg structures 138, such as greater than two (2) of the leg structures 138 (e.g., greater than or equal to three (3) leg structures 138, greater than or equal to five (5) leg structures 138, etc.), or less than two (2) of the leg structures 138 (e.g., one (1) leg structure 138, or no leg structures 138). The leg structures 138 may be symmetrically distributed (e.g., symmetrically horizontally distributed) about the central structure 136, or may be asymmetrically distributed (e.g., asymmetrically horizontally distributed) about the central structure 136. In some embodiments, the leg structures 138 are symmetrically horizontally distributed about the central structure 136.

The upper spring structure 106, including the central structure 136 and the leg structures 138 thereof, may be formed of and include any material that permits the opposing spring structures 104 to limit horizontal movement of one or more components of the magnet assembly 110, and that permits the opposing spring structures 104 to provide the driver assembly 100 with desired acoustic properties. By way of non-limiting example, the upper spring structure 106 may be formed of and include one or more of a metallic material (e.g., a metal, an alloy), a polymeric material (e.g., an elastomeric material, a plastic material), and a ceramic material. The material composition of the upper spring structure 106 may at least partially depend on the geometric configuration (e.g., shape, size) of the upper spring structure 106, and on the configurations (e.g., shapes, sizes, material compositions, material distributions, orientations, arrangements) of the other components of the driver assembly 100 (e.g., the lower spring structure 108, the magnet assembly 110, the spacer structure 112 (if any), the tubular structure 114 (if any)). In some embodiments, the upper spring structure 106 is formed of and includes a metallic material. Suitable metallic materials include, without limitation, elemental metals (e.g., metals of one or more of Groups III A, I B, II B, and VIII B of the Periodic Table of Elements, such as one or more of iron, cobalt, nickel, copper, silver, gold, zinc, and aluminum), an alloy (e.g., an iron-based alloy, a nickel-based alloy, an iron- and nickel-based alloy, a cobalt- and nickel-based alloy, an iron- and cobalt-based alloy, a cobalt- and nickel- and iron-based alloy, an aluminum-based alloy, a copper-based alloy, a steel, a low-carbon steel, a stainless steel, etc.), and a metal-containing material (e.g., a metal nitride, a metal silicide, a metal carbide, a metal oxide). For example, the upper spring structure 106 may comprise a stamped metal spring. In additional embodiments, the upper spring structure 106 is formed of and includes a plastic material. Suitable plastic materials include, without limitation, thermoplastic materials (e.g., polyethylene, polypropylene, polystyrene, polyvinyl chloride, poly(methyl methacrylate), polycarbonate, polyphenylene oxide, polyetherketone, polyetheretherketone, polyaryletherketone, polyetherketoneketone, polyetherketoneetherketoneketone, polyether sulfone, polyphenylene sulfide, polyphenylsulfone, self-reinforced polyphenylene, aromatic polyamide, and polyamideimide), and thermoset plastic materials (e.g., polyimide, polyurethane, phenol-formaldehyde, urea-formaldehyde, polyester). For example, the upper spring structure 106 may comprise a stamped plastic spring. In further embodiments, the upper spring structure 106 is formed of and includes an elastomeric material. Suitable elastomeric materials include, without limitation, natural rubbers, synthetic rubbers (e.g., styrene-butadiene rubbers, polyisoprene rubbers, silicone rubbers), and blends of natural and synthetic rubbers. In some embodiments wherein the upper spring structure 106 comprises a material (e.g., an elastomeric material, a plastic material) other than a metallic material, the upper spring structure 106 may exhibit a different geometric configuration than that depicted in FIG. 1B, such as a geometric configuration similar to that of the lower spring structure 108 described in further detail below, or another geometric configuration.

Referring again to FIG. 1A, the lower spring structure 108 of the opposing spring structures 104 may be positioned below the plate structure 122 of the magnet assembly 110. As shown in FIG. 1A, in embodiments wherein the driver assembly 100 includes the spacer structure 112, at least a portion of the lower spring structure 108 may be positioned below the spacer structure 112. Horizontally peripheral portions 140 (e.g., horizontally outermost portions) of the lower spring structure 108 may be attached (e.g., coupled, bonded, adhered, connected, etc.) to the housing structure 102, and a horizontally central portion 142 of the lower spring structure 108 may be attached to one or more of the spacer structure 112 and the tubular structure 114 (if any). The lower spring structure 108 may be configured to vibrate in accordance with the vertical movement of one or more components (e.g., the permanent magnet 120, the plate structure 122, and the yoke structure 126) of the magnet assembly 110 responsive to a magnetic field produced by the voice coil 124 of the magnet assembly 110 upon receiving an audio signal.

Referring to FIG. 1C, the lower spring structure 108 may comprise a single (e.g., only one), substantially monolithic structure including the horizontally peripheral portions 140 attached to the housing structure 102, and the horizontally central portion 142 attached to the spacer structure 112 and/or the tubular structure 114 (if any). In some embodiments, the lower spring structure 108 is a substantially monolithic spring diaphragm. In additional embodiments, one or more features and/or structures of the lower spring structure 108 are connected (e.g., coupled, bonded, adhered, attached, etc.) to one or more other features and/or structures of the lower spring structure 108 through one or more joint structures (e.g., weld joints, braze joints, solder joints, adhesive joints, etc.) and/or materials.

The lower spring structure 108 may exhibit any desired geometric configuration (e.g., shape and size). The lower spring structure 108 may, for example, exhibit a horizontal geometric configuration (e.g., a horizontal shape and horizontal sizes) at least partially complementary to (e.g., substantially similar to) a horizontal geometric configuration of at least a portion of the magnet assembly 110 (FIG. 1A) thereover. By way of non-limiting example, the lower spring structure 108 may exhibit a curved shape (e.g., an annular shape, a circular shape, an ovular shape, an elliptical shape, etc.) exhibiting a radius of curvature substantially similar to that of the yoke structure 126 (FIG. 1A) of the magnet assembly 110 (FIG. 1A). Outermost horizontal boundaries of the lower spring structure 108 may be substantially coplanar with outermost horizontal boundaries of the yoke structure 126. In additional embodiments, the lower spring structure 108 may exhibit a different geometric configuration (e.g., a different shape and/or a different size). For example, the lower spring structure 108 may exhibit a shape (e.g., a curved shape, a non-curved shape) exhibiting a different radius of curvature than that of the yoke structure 126 (FIG. 1A) of the magnet assembly 110 (FIG. 1A), and/or at least a portion of the outermost horizontal boundaries of the lower spring structure 108 may be non-coplanar with the outermost horizontal boundaries of the yoke structure 126.

Referring again to FIG. 1A, the lower spring structure 108 may include a plurality of corrugations 144 (e.g., a series of alternating ridges and grooves) configured to deform (e.g., comply, expand, compress, etc.) in response to changes (e.g., increases, decreases, etc.) in applied force. The lower spring structure 108 may, for example, comprise a corrugated spring diaphragm. The lower spring structure 108 may include any desired number of the corrugations 144, such as greater than or equal to two (2) corrugations 144 (e.g., from three (3) corrugations 144 to one hundred (100) corrugations 144). In additional embodiments, the lower spring structure 108 is substantially free of corrugations. For example, the lower spring structure 108 may comprise a substantially planar structure, or may comprise an at least partially non-planar structure free of alternating ridges (e.g., elevated regions) and grooves (e.g., recessed regions).

The lower spring structure 108 may be formed of and include any material that permits the opposing spring structures 104 to limit horizontal movement of one or more components of the magnet assembly 110, and that permits the opposing spring structures 104 to provide the driver assembly 100 with desired acoustic properties. By way of non-limiting example, the upper spring structure 106 may be formed of and include one or more of a metallic material, a polymeric material, and a ceramic material. The material composition of the upper spring structure 106 may at least partially depend on the geometric configuration of the upper spring structure 106, and on the configurations (e.g., shapes, sizes, material compositions, material distributions, orientations, arrangements) of the other components of the driver assembly 100 (e.g., the upper spring structure 106, the magnet assembly 110, the spacer structure 112 (if any), the tubular structure 114 (if any)). In some embodiments, the lower spring structure 108 is formed of and includes an elastomeric material. Suitable elastomeric materials include, without limitation, natural rubbers, synthetic rubbers (e.g., styrene-butadiene rubbers, polyisoprene rubbers, silicone rubbers), and blends of natural and synthetic rubbers. In additional embodiments, the lower spring structure 108 is formed of and includes a plastic material. Suitable plastic materials include, without limitation, thermoplastic materials (e.g., polyethylene, polypropylene, polystyrene, polyvinyl chloride, poly(methyl methacrylate), polycarbonate, polyphenylene oxide, polyetherketone, polyetheretherketone, polyaryletherketone, polyetherketoneketone, polyetherketoneetherketoneketone, polyether sulfone, polyphenylene sulfide, polyphenylsulfone, self-reinforced polyphenylene, aromatic polyamide, and polyamideimide), and thermoset plastic materials (e.g., polyimide, polyurethane, phenol-formaldehyde, urea-formaldehyde, polyester). In further embodiments, the lower spring structure 108 is formed of and includes a metallic material. Suitable metallic materials include, without limitation, elemental metals (e.g., metals of one or more of Groups III A, I B, II B, and VIII B of the Periodic Table of Elements, such as one or more of iron, cobalt, nickel, copper, silver, gold, zinc, and aluminum), an alloy (e.g., an iron-based alloy, a nickel-based alloy, an iron- and nickel-based alloy, a cobalt- and nickel-based alloy, an iron- and cobalt-based alloy, a cobalt- and nickel- and iron-based alloy, an aluminum-based alloy, a copper-based alloy, a steel, a low-carbon steel, a stainless steel, etc.), and a metal-containing material (e.g., a metal nitride, a metal silicide, a metal carbide, a metal oxide). In some embodiments wherein the lower spring structure 108 comprises a material (e.g., a metallic material, a plastic material) other than an elastomeric material, the lower spring structure 108 may exhibit a different geometric configuration than that depicted in FIGS. 1A and 1C, such as a geometric configuration similar to that of the upper spring structure 106 previously described with reference to FIGS. 1A and 1B, or another geometric configuration.

In some embodiments, the lower spring structure 108 comprises an elastomeric spring that does not obey Hooke's law. Namely, the force required to displace (e.g., extend, elongate) the lower spring structure 108 from a resting position by some distance may not scale linearly with respect to that distance. Accordingly, the stiffness (e.g., resistance to deformation) of the lower spring structure 108 may also be non-linear. In such embodiments, the lower spring structure 108 may limit excursion and dampen resonance as compared to conventional spring structures.

With continued reference to FIG. 1A, the opposing spring structures 104 may have different geometric configurations and different material compositions than one another. The upper spring structure 106 may, for example, exhibit a different shape (e.g., a different horizontal shape and a different vertical shape), different dimensions (e.g., different horizontal dimensions and different vertical dimensions), and a different material composition than the lower spring structure 108. In additional embodiments, the opposing spring structures 104 may exhibit one or more of at least partially (e.g., substantially) similar geometric configurations and at least partially (e.g., substantially) similar material compositions. The upper spring structure 106 and the lower spring structure 108 may, for example, exhibit one or more of a substantially similar shape (e.g., a substantially similar horizontal shape and/or a substantially similar vertical shape), one or more substantially similar dimensions (e.g., one or more substantially similar horizontal dimensions and/or one or more substantially similar vertical dimensions), and substantially similar material compositions.

The opposing spring structures 104 may be vertically offset (e.g., vertically separated, vertically spaced apart) from one another by any distance $D_1$ capable of vertically containing at least the magnet assembly 110 and the spacer structure 112 (if any) between the opposing spring structures 104. The distance $D_1$ between the opposing spring structures 104 may, for example, be within a range of from about seventy (70) percent of a maximum thickness of the driver assembly 100 to about one hundred (100) percent of the maximum thickness of the driver assembly 100, such as from about seventy-five (75) percent of the maximum thickness of the driver assembly 100 to about ninety-five (95) percent of the maximum thickness of the driver assembly 100, or from about eighty (80) percent of the maximum thickness of the driver assembly 100 to about ninety (90) percent of the maximum thickness of the driver assembly 100.

Figure 2A:
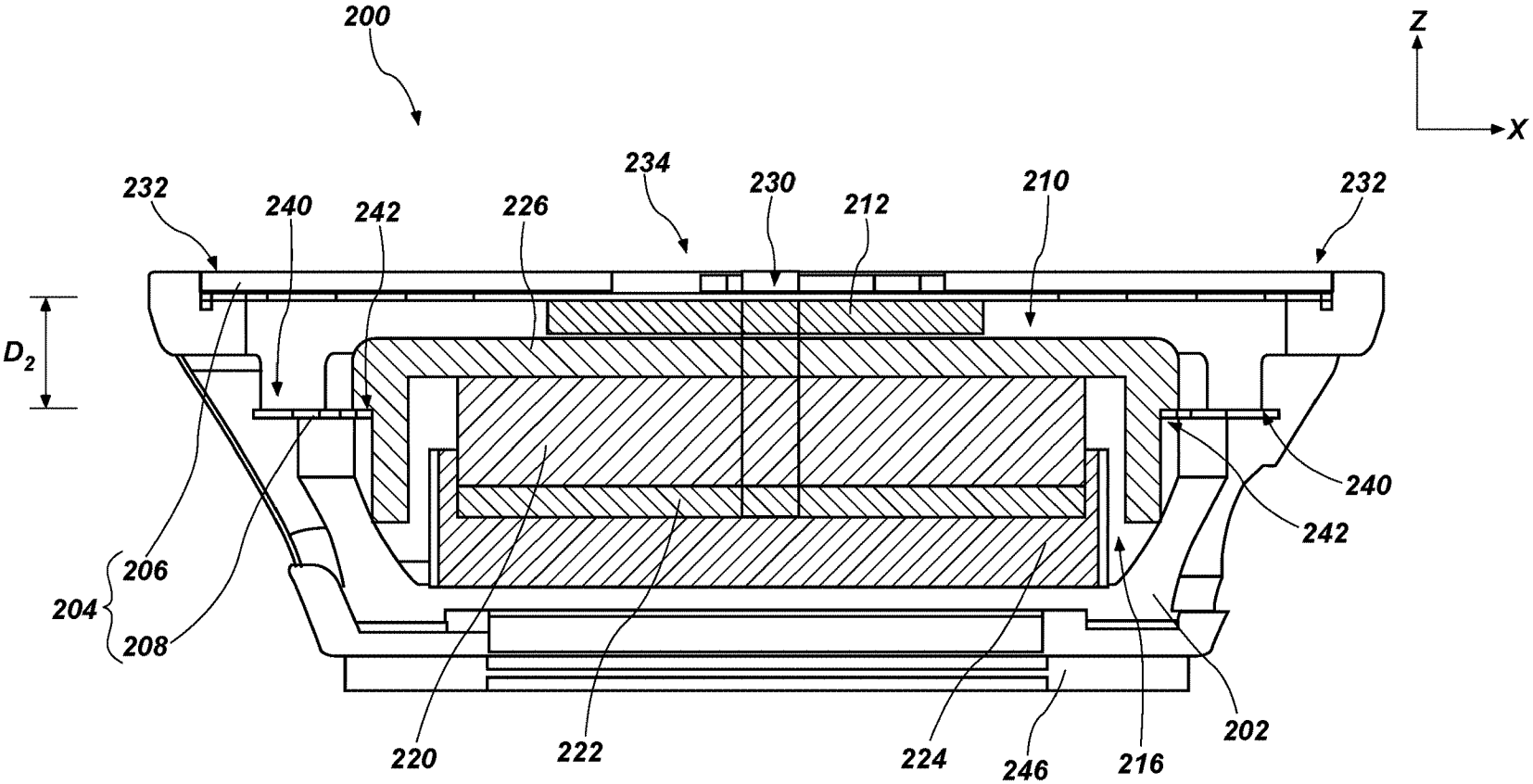
FIGS. 2A and 2B are simplified cross-sectional (FIG. 2A) and top-down (FIG. 2B) views of another driver assembly, in accordance with another embodiment of the disclosure.
Figure 2B:
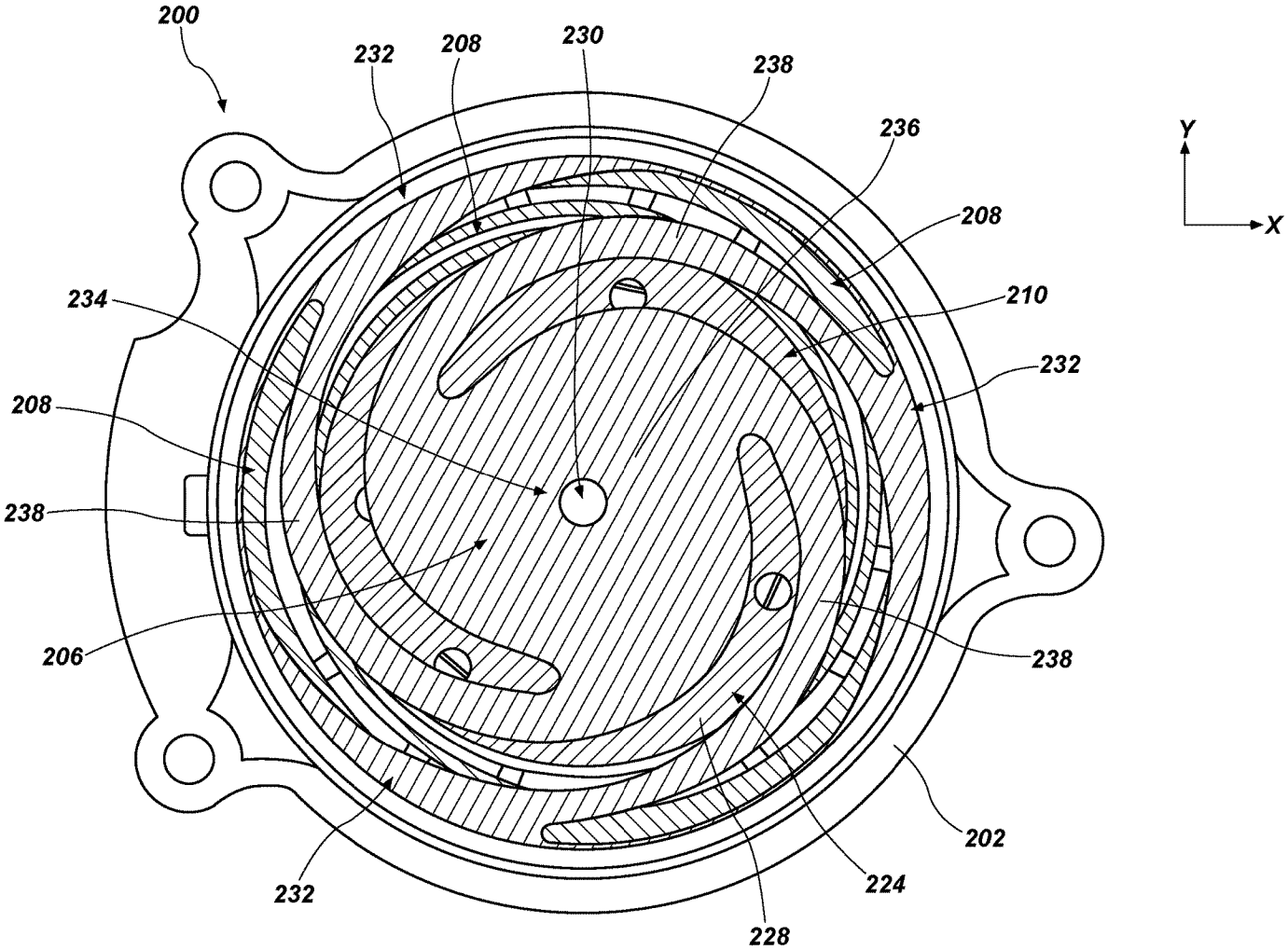

While FIGS. 1A through 1C depict a particular configuration of the driver assembly 100, including particular configurations of the opposing spring structures 104 thereof, different configurations may be employed. By way of non-limiting example, in accordance with additional embodiments of the disclosure, FIGS. 2A and 2B show simplified cross-sectional (FIG. 2A) and top-down (FIG. 2B) views of a driver assembly 200 exhibiting a different configuration than that of the driver assembly 100 shown in FIGS. 1A through 1C. The driver assembly 200 may comprise an audio driver assembly configured to produce audible sound waves, a haptic driver assembly configured to produce haptic communication, or a hybrid driver assembly configured to produce audible sound waves and haptic communication. Throughout FIGS. 2A and 2B and the description associated therewith, functionally similar features are referred to with similar reference numerals incremented by 100. To avoid repetition, not all features shown in FIGS. 2A and 2B are described in detail herein. Rather, unless described otherwise below, a feature designated by a reference numeral that is a 100 increment of the reference numeral of a feature previously-described with respect to one or more of FIGS. 1A through 1C (whether the previously-described feature is first described before the present paragraph, or is first described after the present paragraph) will be understood to be substantially similar to the previously-described feature.

Referring to FIG. 2A, the driver assembly 200 includes a housing structure 202, opposing spring structures 204 secured to the housing structure 202, and a magnet assembly 210 disposed within the housing structure 202. The opposing spring structures 204 may include an upper spring structure 206 positioned at an uppermost end of the housing structure 202, and a lower spring structure 208 underlying the upper spring structure 206. However, unlike the lower spring structure 108 (FIG. 1A) of the driver assembly 100 shown in FIG. 1A, the lower spring structure 208 of the driver assembly 200 may not be positioned at a lowermost end of the housing structure 202, as described in further detail below. Optionally, as shown in FIG. 2A, the driver assembly 200 may also include a spacer structure 212 disposed vertically between the magnet assembly 210 and the upper spring structure 206.

The housing structure 202 of the driver assembly 200 may be configured to be secured within an outer ear-cup housing of an ear-cup assembly, and includes at least one structure configured to at least partially enclose the magnet assembly 210. The housing structure 202 may exhibit similar features (e.g., similar apertures) and may have a similar material composition (e.g., may be formed of and include at least one of a metal material and a polymer material) as the housing structure 102 previously described with reference to FIG. 1A, but may exhibit a different geometric configuration (e.g., a different shape, different dimensions) than the housing structure 102. For example, as shown in FIG. 2B, the housing structure 202 of the driver assembly 200 may exhibit a more circular horizontal peripheral shape as compared to the housing structure 102 of the driver assembly 100 (FIG. 1A). In addition, as shown in FIG. 2A, a barrier structure 246 (e.g., a mesh structure, a screen structure) may, optionally, be attached to a lowermost end of the housing structure 202 to impede (e.g., obstruct) contaminants from entering into an acoustical cavity 216 of the driver assembly 200.

The magnet assembly 210 of the driver assembly 200 may be substantially similar to the magnet assembly 110 of the driver assembly 100 previously described with reference to FIG. 1A. For example, as shown in FIG. 2A, the magnet assembly 210 may include a permanent magnet 220, a plate structure 222 (e.g., a top plate) underlying the permanent magnet 220, a voice coil 224 circumscribing the permanent magnet 220 and the plate structure 222, and a yoke structure 226 at least partially surrounding the permanent magnet 220, the plate structure 222, and the voice coil 224.

The spacer structure 212, if present, may be positioned vertically adjacent at least one surface (e.g., an upper surface of the yoke structure 226) of the magnet assembly 210 so as to partially intervene between the magnet assembly 210 and the upper spring structure 206. The spacer structure 212 may be centrally horizontally positioned relative to horizontal dimensions (e.g., widths, lengths, diameters) of each of the magnet assembly 210 and the opposing spring structures 204. The spacer structure 212 may be configured to permit movement of one or more components (e.g., the permanent magnet 220, the plate structure 222, and the yoke structure 226) of the magnet assembly 210 and the spacer structure 212 responsive to a magnetic field produced by the voice coil 224 of the magnet assembly 210 upon receiving an audio signal from a media player. The magnet assembly 210 and/or the upper spring structure 206 may be attached (e.g., adhered, bonded, coupled, etc.) to one or more portions of the spacer structure 212. The spacer structure 212 may be formed of and include at least one of a polymer material (e.g., a plastic) and metal material (e.g., a metal, an alloy, etc.). In additional embodiments, the spacer structure 212 is absent (e.g., omitted) from the driver assembly 200.

With continued reference to FIG. 2A, similar to the opposing spring structures 104 (FIG. 1A) of the driver assembly 100 (FIG. 1A), the opposing spring structures 204 (e.g., the upper spring structure 206, and the lower spring structure 208) of the driver assembly 200 are configured and positioned to limit horizontal movement of one or more components of the magnet assembly 210, while also permitting vertical movement of the one or more components of the magnet assembly 210. For example, the opposing spring structures 204 may be configured and positioned to substantially limit horizontal movement of the permanent magnet 220, the plate structure 222, and the yoke structure 226 of the magnet assembly 210, while permitting vertical movement of the permanent magnet 220, the plate structure 222, and the yoke structure 226 of the magnet assembly 210. The opposing spring structures 204 may also provide the driver assembly 200 with desired acoustic properties. For example, the opposing spring structures 204 may be configured and positioned to reduce the vibration amplitude at resonance of one or more components of driver assembly 200. The opposing spring structures 204 may facilitate a relatively more even (e.g., uniform) vibration response for the driver assembly 200 across a relatively wider range of frequencies.

As shown in FIG. 2A, the upper spring structure 206 may be positioned over the yoke structure 226 of a magnet assembly 210. In some embodiments, such as embodiments wherein the driver assembly 200 comprises an audio driver assembly, the upper spring structure 206 is an audio producing component of the driver assembly 200. In additional embodiments, such as embodiments wherein the driver assembly 200 comprises a haptic driver assembly, the upper spring structure 206 is not an audio producing component of the driver assembly 200. In embodiments wherein the driver assembly 200 includes the spacer structure 212, at least a portion of the upper spring structure 206 may be positioned above the spacer structure 212. Horizontally peripheral portions 232 (e.g., horizontally outermost portions) of the upper spring structure 206 may be attached (e.g., coupled, bonded, adhered, connected, etc.) to the housing structure 202 of the driver assembly 200, and a horizontally central portion 234 of the upper spring structure 206 may be attached to one or more of the spacer structure 212 (if any) and the yoke structure 226 of the magnet assembly 210. Similar to the upper spring structure 106 shown in FIG. 1B, the upper spring structure 206 of the driver assembly 200 may be configured to vibrate in accordance with the vertical movement of one or more components (e.g., the permanent magnet 220, the plate structure 222, and the yoke structure 226) of the magnet assembly 210 responsive to a magnetic field produced by the voice coil 224 of the magnet assembly 210 upon receiving an audio signal.

Referring to FIG. 2B, the upper spring structure 206 includes a central structure 236 overlying the magnet assembly 210 and exhibiting a different geometric configuration than the central structure 136 of the upper spring structure 106 shown in FIG. 1B, and a plurality of leg structures 238 horizontally extending from the central structure 236 and exhibiting different geometric configurations than the leg structures 138 of the upper spring structure 106 shown in FIG. 1B. The central structure 236 may include the horizontally central portion 234 attached to one or more of the magnet assembly 210 and the spacer structure 212 (FIG. 2A) (if any), and the leg structures 238 may include the horizontally peripheral portions 232 attached to the housing structure 202. The central structure 236 and the leg structures 238 may be integral and continuous with one another, such that the upper spring structure 206 comprises a substantially monolithic structure; or the central structure 236 may be connected (e.g., coupled, bonded, adhered, attached, etc.) to one or more of the leg structures 238 through one or more joint structures (e.g., weld joints, braze joints, solder joints, adhesive joints, etc.) and/or materials.

The central structure 236 of the upper spring structure 206 may exhibit a curved shape having one or more radiuses of curvature different than that of the yoke structure 226 (FIG. 2A) of the magnet assembly 210. In addition, outermost horizontal boundaries of the central structure 236 may be non-coplanar (e.g., unaligned) with outermost horizontal boundaries of the yoke structure 226. For example, the outermost horizontal boundaries of the central structure 236 may be positioned horizontally inward of the outermost horizontal boundaries of the yoke structure 226, such that the central structure 236 only partially (e.g., less than completely) covers the magnet assembly 210.

With continued reference to FIG. 2B, the leg structures 238 of the upper spring structure 206 extend in paths (e.g., non-linear paths, such as curved paths) and exhibit geometric configurations (e.g., shapes and sizes) different than the paths and geometric configurations of the leg structures 138 of the upper spring structure 106 shown in FIG. 1B. For example, the leg structures 238 of the upper spring structure 206 may outwardly horizontally extend in curved, non-oscillating paths (and, hence, may exhibit curved, non-oscillating shapes) from the central structure 236 to the housing structure 202. Each of the leg structures 238 may exhibit substantially the same shape and substantially the same size as one another, or at least one of the leg structures 238 may exhibit a different shape and/or a different size than at least one other of the leg structures 238. As shown in FIG. 2B, portions of the leg structures 238 proximate the central structure 236 may cover (e.g., vertically overlie) portions of the magnet assembly 210 (e.g., portions of the yoke structure 226 shown in FIG. 2A).

As depicted in FIG. 2B, in some embodiments, the upper spring structure 206 includes three (3) of the leg structures 238. In additional embodiments, the upper spring structure 206 includes a different number of the leg structures 238, such as greater than three (3) of the leg structures 238 (e.g., greater than or equal to four (4) leg structures 238, greater than or equal to five (5) leg structures 238, etc.), or less than three (3) of the leg structures 238 (e.g., two (2) leg structures 238). Each of the leg structures 238 may be separated (e.g., circumferentially separated) from each other of the leg structures 238 adjacent thereto by substantially the same distance, or at least one of the leg structures 238 may be separated from one of the leg structures 238 adjacent thereto by a different distance than that between of the at least one of the leg structures 238 and another of the leg structures 238 adjacent thereto. The leg structures 238 may be symmetrically distributed (e.g., symmetrically horizontally distributed) about the central structure 236, or may be asymmetrically distributed (e.g., asymmetrically horizontally distributed) about the central structure 236. In some embodiments, the leg structures 238 are symmetrically horizontally distributed about the central structure 236.

The material composition of the upper spring structure 206, including the material compositions of the central structure 236 and the leg structures 238 thereof, may be substantially similar to the material composition of the upper spring structure 106 previously described with respect to FIG. 1B. By way of non-limiting example, the upper spring structure 106 may be formed of and include one or more of a metallic material (e.g., a metal, an alloy), a polymeric material (e.g., an elastomeric material, a plastic material), and a ceramic material. In some embodiments, the upper spring structure 206 of the driver assembly 200 is formed of and includes a metallic material. For example, the upper spring structure 206 may comprise a stamped metal spring. In additional embodiments, the upper spring structure 206 of the driver assembly 200 is formed of and includes a plastic material. For example, the upper spring structure 206 may comprise a stamped plastic spring.

Referring again to FIG. 2A, the lower spring structure 208 of the opposing spring structures 204 may be located at a position vertically above a lowermost end of the housing structure 202. Accordingly, the lower spring structure 208 may be located at a vertical position more proximate a vertical center of the driver assembly 200. As shown in FIG. 2A, the lower spring structure 208 may be located at the same vertical position as a portion of the magnet assembly 210. For example, the lower spring structure 208 may be positioned vertically between a lower surface of the voice coil 224 and an upper surface of the yoke structure 226, such as vertically between a lower surface of the plate structure 222 and the upper surface of the yoke structure 226, or vertically between a lower surface of the permanent magnet 220 and an upper surface of the permanent magnet 220 opposing the lower surface of the permanent magnet 220. Horizontally peripheral portions 240 (e.g., horizontally outermost portions) of the lower spring structure 208 may be attached (e.g., coupled, bonded, adhered, connected, etc.) to the housing structure 202, and a horizontally central portion 242 of the lower spring structure 208 may be attached to the yoke structure 226 (e.g., to a side surface of the yoke structure 226) of the magnet assembly 210. The lower spring structure 208 may be configured to vibrate in accordance with the vertical movement of one or more components (e.g., the permanent magnet 220, the plate structure 222, and the yoke structure 226) of the magnet assembly 210 responsive to a magnetic field produced by the voice coil 224 of the magnet assembly 210 upon receiving an audio signal.

In some embodiments, the lower spring structure 208 comprises a single (e.g., only one), substantially monolithic structure. In additional embodiments, one or more features and/or structures of the lower spring structure 208 are connected (e.g., coupled, bonded, adhered, attached, etc.) to one or more other features and/or structures of the lower spring structure 208 through one or more joint structures (e.g., weld joints, braze joints, solder joints, adhesive joints, etc.) and/or materials.

The lower spring structure 208 may exhibit any geometric configuration (e.g., shape and size) capable of limiting horizontal movement of one or more components (e.g., the permanent magnet 220, the plate structure 222, and the yoke structure 226) of the magnet assembly 210, while also permitting vertical movement of the one or more components of the magnet assembly 210. By way of non-limiting example, the lower spring structure 208 may exhibit a curved shape (e.g., an annular shape) including leg structures extending in non-linear paths (e.g., curved paths) from a horizontally innermost boundary of the lower spring structure 208 to a horizontally outermost boundary of the lower spring structure 208. The leg structures may, for example, be similar to the leg structures 238 (FIG. 2B) of the upper spring structure 206.

The material composition of the lower spring structure 208 may be substantially similar to the material composition of the lower spring structure 108 previously described with respect to FIGS. 1A and 1C. By way of non-limiting example, the lower spring structure 208 may be formed of and include one or more of a metallic material (e.g., a metal, an alloy), a polymeric material (e.g., an elastomeric material, a plastic material), and a ceramic material. In some embodiments, the lower spring structure 208 of the driver assembly 200 is formed of and includes a plastic material. For example, the lower spring structure 208 may comprise a stamped plastic spring. In additional embodiments, the lower spring structure 208 is formed of and includes a metallic material. For example, the lower spring structure 208 may comprise a stamped metal spring.

With continued reference to FIG. 2A, the opposing spring structures 204 may have different geometric configurations and different material compositions than one another. The upper spring structure 206 may, for example, exhibit a different shape (e.g., a different horizontal shape and a different vertical shape), different dimensions (e.g., different horizontal dimensions and different vertical dimensions), and a different material composition than the lower spring structure 208. In additional embodiments, the opposing spring structures 204 exhibit one or more of at least partially (e.g., substantially) similar geometric configurations and at least partially (e.g., substantially) similar material compositions. The upper spring structure 206 and the lower spring structure 208 may, for example, exhibit different geometric configurations than one another, but substantially similar material compositions.

The opposing spring structures 204 may be vertically offset (e.g., vertically separated, vertically spaced apart) from one another by any distance $D_2$ permitting the suspension and desired vertical movement of at least the permanent magnet 220, the plate structure 222, and the yoke structure 226 of the magnet assembly 210. The distance $D_2$ between the opposing spring structures 204 of the driver assembly 200 may be less than the distance $D_1$ (FIG. 1A) between the opposing spring structures 104 (FIG. 1A) of the driver assembly 100 (FIG. 1A). The distance $D_2$ between the opposing spring structures 204 may be within a range of from about ten (10) percent of a maximum thickness of the driver assembly 100 to about seventy (70) percent of the maximum thickness of the driver assembly 100, such as from about twenty (20) percent of the maximum thickness of the driver assembly 100 to about sixty (60) percent of the maximum thickness of the driver assembly 100, or from about thirty (30) percent of the maximum thickness of the driver assembly 100 to about fifty (50) percent of the maximum thickness of the driver assembly 100.

Referring collectively to FIGS. 2A and 2B, the driver assembly 200 may exhibit other structural differences relative to the driver assembly 100 shown in FIGS. 1A through 1C. By way of non-limiting example, as shown in FIGS. 2A and 2B, the driver assembly 200 may be free of a tubular structure similar to the tubular structure 114 of the driver assembly 100 shown in FIGS. 1A through 1C. Accordingly, a central vertical aperture 230 of the driver assembly 200 may, for example, comprise a combination of a centrally horizontally positioned aperture extending through the upper spring structure 206 and another centrally horizontally positioned aperture extending through the magnet assembly 210.

Figure 3:
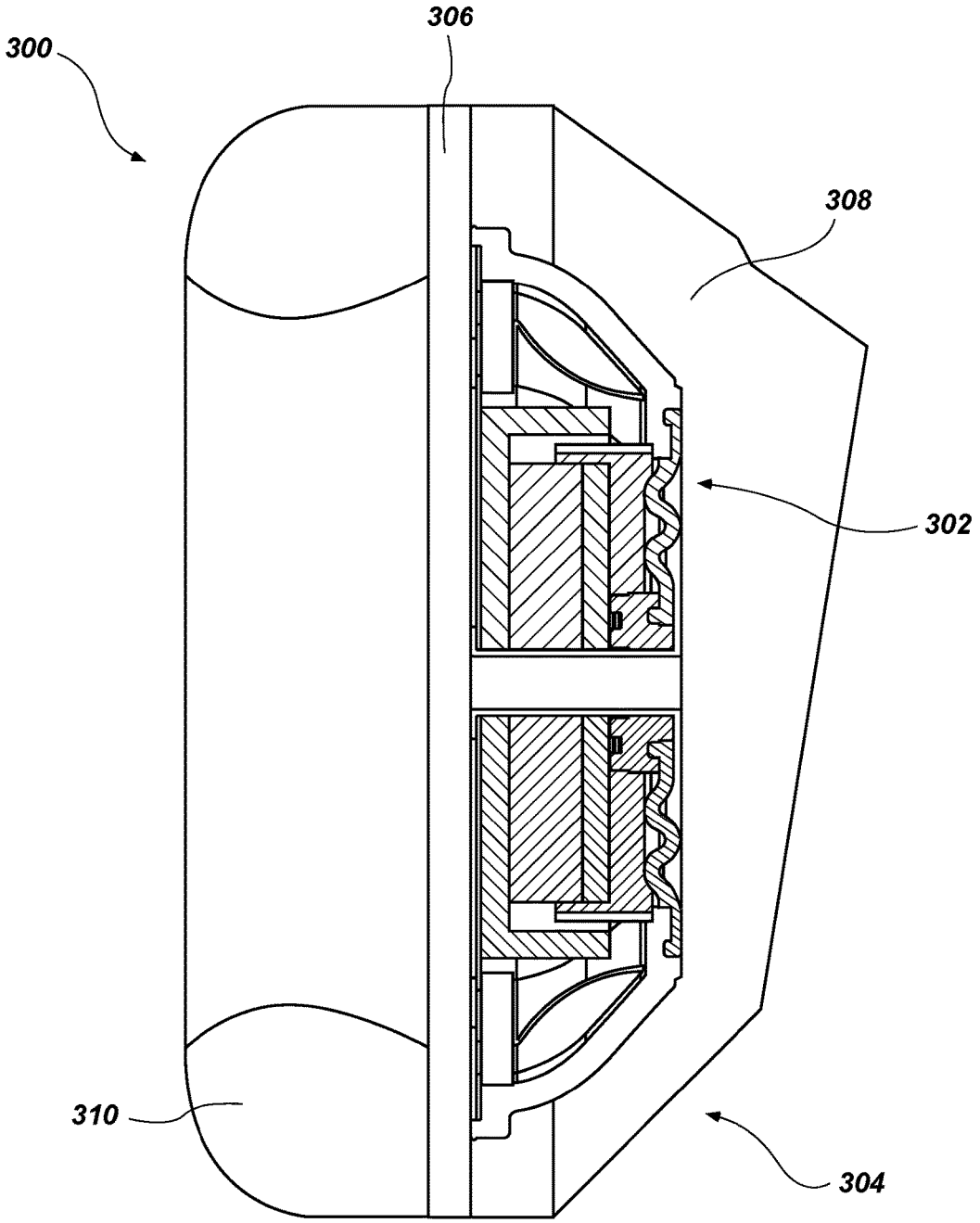
FIG. 3 is a simplified cross-sectional view of an ear-cup assembly, in accordance with an embodiment of the disclosure.

Driver assemblies (e.g., the driver assemblies 100, 200) of the disclosure may be employed in ear-cup assemblies of the disclosure. FIG. 3 is a simplified cross-sectional view illustrating of an ear-cup assembly 300, in accordance with an embodiment of the disclosure. The ear-cup assembly 300 includes a driver assembly 302, wherein the driver assembly 302 is substantially similar to the driver assembly 100 previously described herein with reference to FIGS. 1A through 1C, or the driver assembly 200 previously described herein with reference to FIGS. 2A and 2B. The driver assembly 302 may be the only driver assembly of the ear-cup assembly 300, or may be one of multiple driver assemblies of the ear-cup assembly 300. In some embodiments, the driver assembly 302 is one of at least two driver assemblies of the ear-cup assembly 300, wherein the driver assembly 302 is configured to produce haptic communication, and another driver assembly is configured to produce audible sound waves. The ear-cup assembly 300 also includes an outer ear-cup housing 304 including at least two members assembled together around the driver assembly 302. As a non-limiting example, the outer ear-cup housing 304 may include a front member 306, and a back member 308 connected to the front member 306. The members of the outer ear-cup housing 304 (e.g., the front member 306, the back member 308, etc.) may each independently be formed of and include at least one of a metal material (e.g., a metal, a metal alloy, etc.) and a polymer material (e.g., a plastic material), and may serve as a frame structure for the ear-cup assembly 300. The ear-cup assembly 300 may also include a cushion 310 attached to or otherwise carried on the outer ear-cup housing 304.

Figure 4:
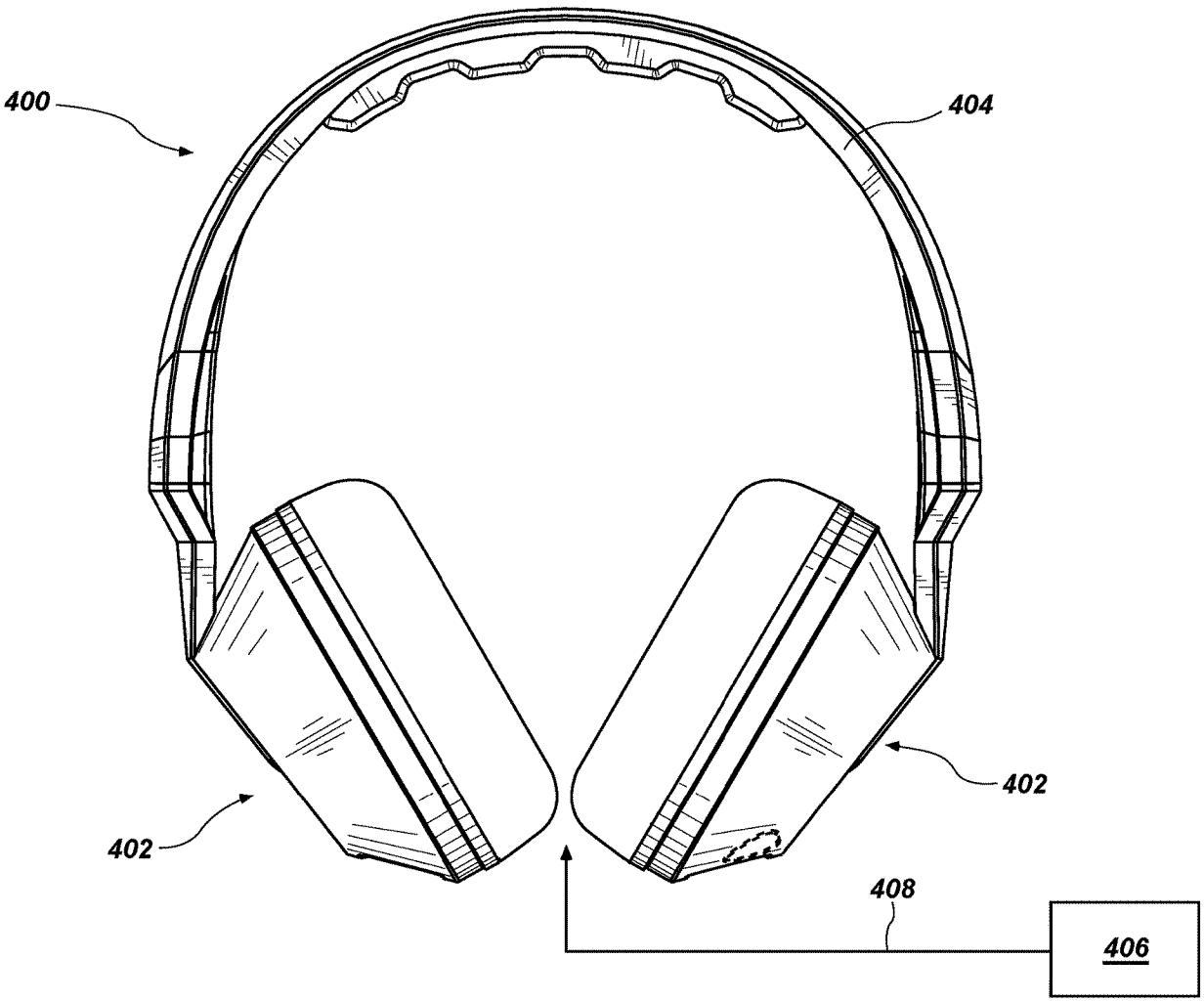
FIG. 4 is a simplified side elevation view of a headphone, in accordance with an embodiment of the disclosure.

Ear-cup assemblies (e.g., the ear-cup assembly 300) of the disclosure may be employed in headphones of the disclosure. FIG. 4 is a simplified vertical view illustrating a headphone 400, in accordance with an embodiment of the disclosure. The headphone 400 includes two (2) ear-cup assemblies 402, wherein the ear-cup assemblies 402 are substantially similar to the ear-cup assembly 300 previously described herein with reference to FIG. 3. The headphone 400 also includes a headband 404 connected to each of the ear-cup assemblies 402. The headband 404 may be configured to rest on the head of a user and to support the ear-cup assemblies 402 on or over the user's ears. The headphone 400 may be configured to receive an electronic audio signal from a media player 406 through a connection 408 (e.g., a wired connection, a wireless connection, etc.) between the headphone 400 and the media player 406. The media player 406 may comprise any device or system capable of producing an audio signal. By way of non-limiting example, the media player 406 may comprise a portable digital music player, a portable compact disc player, a portable cassette player, a mobile phone, a smartphone, a personal digital assistant (PDA), a radio (e.g., AM radio, FM radio, HD radio, satellite radio, etc.), a television, an e-book reader, a portable gaming system, a portable DVD player, a laptop computer, a tablet computer, a desktop computer, a stereo system, and/or other devices or systems that may be created hereafter.

While the disclosure is susceptible to various modifications and alternative forms, specific embodiments have been shown by way of example in the drawings and have been described in detail herein. However, the disclosure is not limited to the particular forms disclosed. Rather, the disclosure is to cover all modifications, equivalents, and alternatives falling within the scope of the disclosure as defined by the following appended claims and their legal equivalents.

What is claimed is:

1. A driver assembly, comprising:

a housing structure;

a magnet assembly within the housing structure and comprising:

a permanent magnet;

a plate structure underlying the permanent magnet;

a voice coil circumscribing the permanent magnet and the plate structure; and a yoke structure at least partially surrounding the permanent magnet, the plate structure, and the voice coil;

opposing spring structures coupled to the housing structure at different vertical positions than one another and configured to impede horizontal movement of the permanent magnet, the plate structure, and the yoke structure while permitting vertical movement thereof; and a tubular structure provided within and vertically extending through aligned, centrally horizontally positioned apertures in the opposing spring structures and the magnet assembly.

2. The driver assembly of claim 1, wherein the opposing spring structures comprise:

a first spring structure overlying the magnet assembly; and a second spring structure underlying the first spring structure.

3. The driver assembly of claim 2, wherein the first spring structure and the second spring structure each individually comprise one or more of a metallic material and a polymeric material.

4. The driver assembly of claim 2, wherein the second spring structure comprises an elastomeric spring configured to limit excursion and dampen resonance.

5. The driver assembly of claim 2, wherein the first spring structure comprises:

a central structure overlying the yoke structure of the magnet assembly; and leg structures outwardly laterally extending from the central structure to the housing structure.

6. The driver assembly of claim 5, wherein the leg structures outwardly laterally extend in non-linear paths from the central structure to the housing structure.

7. The driver assembly of claim 2, wherein the second spring structure underlies the magnet assembly.

8. The driver assembly of claim 7, wherein the second spring structure exhibits a plurality of corrugations.

9. The driver assembly of claim 2, wherein the second spring structure is positioned vertically between a lower surface of the voice coil of the magnet assembly and an upper surface of the yoke structure of the magnet assembly.

10. The driver assembly of claim 9, wherein the second spring structure is attached to and laterally extends between the yoke structure and the housing structure.

11. The driver assembly of claim 9, wherein the second spring structure comprises leg structures outwardly laterally extending in non-linear paths from the yoke structure to the housing structure.

12. The driver assembly of claim 1, wherein the tubular structure exhibits lateral projections at opposing vertical ends thereof, and the opposing spring structures are attached to the lateral projections.

13. A driver assembly, comprising:

a housing structure;

a magnet assembly within the housing structure and comprising:

a permanent magnet;

a plate structure underlying the permanent magnet;

a voice coil circumscribing the permanent magnet and the plate structure; and a yoke structure at least partially surrounding the permanent magnet, the plate structure, and the voice coil;

opposing spring structures coupled to the housing structure at different vertical positions than one another and configured to impede horizontal movement of the permanent magnet, the plate structure, and the yoke structure while permitting vertical movement thereof, the opposing spring structures comprising:

a first spring structure overlying the magnet assembly; and a second spring structure underlying the first spring structure and the magnet assembly; and a spacer structure positioned vertically between the plate structure of the magnet assembly and the second spring structure.

14. A driver assembly, comprising:

a housing structure;

a magnet assembly within the housing structure and comprising:

a permanent magnet;

a plate structure underlying the permanent magnet;

a voice coil circumscribing the permanent magnet and the plate structure; and a yoke structure at least partially surrounding the permanent magnet, the plate structure, and the voice coil;

opposing spring structures coupled to the housing structure at different vertical positions than one another and configured to impede horizontal movement of the permanent magnet, the plate structure, and the yoke structure while permitting vertical movement thereof, the opposing spring structures comprising:

a first spring structure overlying the magnet assembly; and a second spring structure underlying the first spring structure and positioned vertically between a lower surface of the voice coil of the magnet assembly and an upper surface of the yoke structure of the magnet assembly; and a spacer structure positioned vertically between the yoke structure of the magnet assembly and the first spring structure.

15. A headphone, comprising:

an ear-cup housing; and a driver assembly disposed at least partially within the ear-cup housing, the driver assembly comprising:

a housing structure;

a magnet assembly within the housing structure and comprising:

a permanent magnet;

a plate structure underlying the permanent magnet;

a voice coil circumscribing the permanent magnet and the plate structure; and a yoke structure at least partially surrounding the permanent magnet, the plate structure, and the voice coil;

opposing spring structures coupled to the housing structure at different vertical positions than one another and configured to impede horizontal movement of the permanent magnet, the plate structure, and the yoke structure while permitting vertical movement thereof; and a tubular structure provided within and vertically extending through aligned, centrally horizontally positioned apertures in the opposing spring structures and the magnet assembly.

16. The headphone of claim 15, wherein the opposing spring structures of the magnet assembly comprise:

a stamped metal spring overlying the magnet assembly; and an elastomeric spring underlying the magnet assembly.

17. The headphone of claim 15, wherein the opposing spring structures of the magnet assembly comprise:

a stamped metal spring overlying an upper surface of the yoke structure of the magnet assembly; and a stamped plastic spring positioned vertically between the upper surface of the yoke structure of the magnet assembly and a lower surface of the plate structure of the magnet assembly.

18. A headphone, comprising:

an ear-cup housing; and a driver assembly disposed at least partially within the ear-cup housing, the driver assembly comprising:

a housing structure;

a magnet assembly within the housing structure and comprising:

a permanent magnet;

a plate structure underlying the permanent magnet;

a voice coil circumscribing the permanent magnet and the plate structure; and a yoke structure at least partially surrounding the permanent magnet, the plate structure, and the voice coil;

opposing spring structures coupled to the housing structure at different vertical positions than one another and configured to impede horizontal movement of the permanent magnet, the plate structure, and the yoke structure while permitting vertical movement thereof; and at least one spacer structure positioned outwardly vertically adjacent at least one of the opposing spring structures.

19. A method of forming a headphone, comprising:

forming a driver assembly, the driver assembly comprising:

a housing structure;

a magnet assembly within the housing structure and comprising:

a permanent magnet;

a plate structure underlying the permanent magnet;

a voice coil circumscribing the permanent magnet and the plate structure; and a yoke structure at least partially surrounding the permanent magnet, the plate structure, and the voice coil;

opposing spring structures coupled to the housing structure at different vertical positions than one another and configured to impede horizontal movement of the permanent magnet, the plate structure, and the yoke structure while permitting vertical movement thereof; and a tubular structure provided within and vertically extending through aligned, centrally horizontally positioned apertures in the opposing spring structures and the magnet assembly; and securing the driver assembly within an ear-cup housing.

* * * * *